US006242059B1

(12) United States Patent
Jansen et al.

(10) Patent No.: US 6,242,059 B1
(45) Date of Patent: Jun. 5, 2001

(54) NONFELTING WOOL AND ANTIFELT FINISHING PROCESS

(75) Inventors: Bernhard Jansen, Köln; Ferdinand Kümmeler, Leverkusen; Helga Thomas, Herzogenrath; Claus Müller-Reich, Osterholz-Scharmbeck, all of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/457,287

(22) Filed: Dec. 8, 1999

(30) Foreign Application Priority Data

Dec. 18, 1998 (DE) ..... 198 58 736

(51) Int. Cl.[7] ..... D06M 10/02; D06M 15/568

(52) U.S. Cl. ..... 427/562; 427/569; 8/128.1; 8/115.52

(58) Field of Search ..... 8/128.3, 115.52; 427/562, 569

(56) References Cited

U.S. PATENT DOCUMENTS

| | | | |
|---|---|---|---|
| 3,428,592 | 2/1969 | Youker | 260/29.2 |
| 3,653,957 | 4/1972 | Schafer et al. | 117/141 |
| 3,847,543 | 11/1974 | Carroll | 8/127.6 |
| 5,503,714 | 4/1996 | Reiners et al. | 162/164.6 |

FOREIGN PATENT DOCUMENTS

| | | | |
|---|---|---|---|
| 2657513 | | 7/1977 | (DE) . |
| 4344428 | | 6/1995 | (DE) . |
| 19731562 | | 1/1999 | (DE) . |
| 19736542 A1 | * | 2/1999 | (DE) . |
| 0 013 112 | | 7/1980 | (EP) . |
| 0 758 417 | | 8/1999 | (EP) . |
| 0 828 890 | | 8/1999 | (EP) . |
| 1294193 | | 1/1970 | (GB) . |
| 1262977 | | 2/1972 | (GB) . |
| 8-188969A | * | 7/1996 | (JP) . |
| 95/30045 | * | 11/1995 | (WO) . |
| 97/41293 | | 11/1997 | (WO) . |

OTHER PUBLICATIONS

Patent Abstracts of Japan, vol. 1996, No. 01, Jan. 31, 1996, & JP 07 243177 A (Toshio Kondo) Sep. 19, 1995.

Thorsen W. J. A Corona Discharge Method of Producing Shrink–Resistant Wool and Mohair.
Part II: Effects of Temperature, Chlorine Gas, and Moisture, Textile Research Journal, US, Textile Research Institute. rinceton, N.J., vol. 38, Jun. 1, 1968, pp. 644–650, XP002039320 ISSN: 0040–5175.

* cited by examiner

*Primary Examiner*—Margaret Einsmann
(74) *Attorney, Agent, or Firm*—Joseph C. Gil; Richard E. L. Henderson

(57) ABSTRACT

The invention relates to the antifelt finishing of wool in which the wool is (a) first exposed to a plasma in a corona treatment and (b) subsequently treated with an aqueous dispersion of self-dispersing isocyanates.

12 Claims, No Drawings

NONFELTING WOOL AND ANTIFELT FINISHING PROCESS

BACKGROUND OF THE INVENTION

The invention relates to nonfelting wool and to a process for producing it by (a) a plasma treatment of the wool and (b) an after-treatment with aqueous dispersions of self-dispersing isocyanates.

The textile processing industry has a particular interest in reducing the felting tendency of wool, especially of raw wool or unprocessed wool. The felting of wool is customarily reduced by finishing with specific auxiliaries.

Isocyanates for the antifelt finishing of textiles are well known and can be used, for example, as described in DE-A 1,904,802, in organic solvents or, as described in DE-A 1,769,121, in aqueous dispersion with the aid of emulsifiers. Both organic solvents and possibly water-polluting emulsifiers are today no longer appropriate for ecological and occupational hygiene reasons. Prior artisans therefore developed self-dispersing isocyanates and also formulations containing very low levels of solvents or emulsifiers as auxiliaries and additives.

DE-A 1,794,221 describes the treatment of fiber materials with isocyanate prepolymers which still contain free isocyanate groups. This finishing process can take place in solvents such as perchloroethylene or in aqueous emulsion by using auxiliary emulsifiers.

U.S. Pat. No. 3,847,543 discloses a process for the antifelt finishing of wool using an aqueous dispersion simultaneously containing aliphatic isocyanates, OH-functional crosslinkers, and organometallic catalysts. Although this process takes place in an aqueous phase, auxiliary solvents and emulsifiers continue to be required.

DE-A 2,657,513 describes a process for the antifelt finishing of wool by treating the wool yarn with an aqueous liquor that contains the felt-proofing agent. The feltproofing agents used are reactive polyolefins, reaction products of polyisocyanates and hydroxyl compounds, silicone polymers, aziridine compounds, reaction products of epoxides with fatty amines and dicarboxylic acids or polyamides, reaction products with thiosulfate end groups, or, preferably, reaction products with mercapto end groups.

WO 95/30045 describes a process utilizing specific isocyanates for the antifelt finishing of wool. No solvents or emulsifiers are needed because the isocyanates used are water-dispersible. The wool is first subjected to a pretreatment with oxidizing agents, followed by a reductive treatment, before the water-dispersible isocyanates are used. The disadvantage with this process is that the oxidative and reductive pretreatment gives rise to wastewaters that must be properly neutralized and treated.

The prior art further includes another method for the antifelt finishing of wool where the wool is treated with a plasma. DE-A 4,344,428 discloses, for example, a process in which the wool is subjected to an antifelt finish comprising a combination of plasma or corona pretreatment and enzymatic aftertreatment. The wool is sensitized with a solution that contains sulfide ions prior to the enzyme treatment.

DE 196 16 776 Cl further describes a process for the antifelt finishing of wool where moist wool material having a water content of 4 to 40% by weight is exposed to a low pressure plasma treatment before being further processed into textile fabrics or sheets. The wool is subjected to a radio frequency discharge at a frequency of 1 kHz to 3 GHz and a power density of 0.001 to 3 W/cm$^3$ at a pressure of $10^{-2}$ to 10 mbar for a period of 1 to 600 sec in the presence or absence of non-polymerizing gases. The disadvantage with this process is the complicated equipment. Specific vacuum pumps are needed, and vacuum locks must be fitted so that the material may enter and exit without streaming.

The German Patent Application bearing the file reference 197 36 542.6 (unpublished at the priority date of the present invention) discloses a process for the antifelt finishing of wool in which the wool is initially likewise pretreated with a low pressure plasma and subsequently aftertreated with aqueous dispersions of self-dispersing isocyanates. Again, the equipment needed for the low pressure plasma treatment is a disadvantage.

The invention has for its object to provide by a technically improved process nonfelting wool which after further processing into made-up merchandise does not felt and shrink in machine washing.

SUMMARY OF THE INVENTION

The present invention provides nonfelting wool prepared by a process comprising (a) exposing wool to a plasma in a corona treatment, and (b) subsequently treating the treated wool with an aqueous dispersion of self-dispersing isocyanates.

The present invention further provides a process for the antifelt finishing of wool comprising (a) exposing the wool to a plasma in a corona treatment, and (b) subsequently treating the treated wool with an aqueous dispersion of self-dispersing isocyanates.

DETAILED DESCRIPTION OF THE INVENTION

The wool used may be selected from a very wide range of wool materials, for example, raw wool after the raw wool scour, dyed or undyed wool slubbing, or dyed or undyed wool yarn, knits, or cloths. The water content of the wool is customarily 4 to 40% by weight (preferably 5 to 30% by weight, particularly preferably 6 to 25% by weight, especially 8 to 15% by weight).

Step (a) of the process of the invention requires that the wool be exposed to a plasma in a corona treatment. The corona treatment is carried out at a pressure within the range from 100 mbar to 1.5 bar, preferably at atmospheric pressure.

The corona treatment subjects the wool to a radiofrequency discharge customarily having a power density of 0.01 to 5 Ws/cm$^2$ for a period of 1 to 60 seconds (preferably 2 to 40 seconds, particularly 3 to 30 seconds) in the presence or absence of non-polymerizing gases. Suitable non-polymerizing gases are air, oxygen, nitrogen, noble gases, or mixtures thereof.

The actual plasma is generated by applying an alternating voltage of 1 to 20 kV in the frequency range between 1 kHz to 1 GHz (preferably 1 to 100 kHz) to electrodes, one or both poles being provided with an insulator material. The alternating voltage can be supplied either continuously or with individual pulses or with pulse trains and pauses in between.

The design and apparatus configurations of a corona reactor are known and described for example in the German Application bearing the file reference 197 31 562 (unpublished at the priority date of the present invention). The corona treatment is preferably carried out by electric discharges in the atmospheric pressure region, for which the wool to be treated is initially introduced into a sealed, tight treatment housing, charged there with the working gas (i.e., the above-mentioned non-polymerizing gas) and subsequently exposed to an electric barrier discharge in a gap between the two treatment electrodes. The distance of the wool material from the treatment electrodes is 0 to 15 mm (preferably 0.1 to 5 mm, particularly 0.3 to 2 mm). The treatment electrodes are preferably constructed as rotatable rolls, either or both of which are coated with electrically refractory dielectric material.

The special effect of the plasma treatment in step (a) of the process of the invention can be explained as follows. The liquid present in the fiber desorbs from the fiber surface as water vapor/gas during the process. High energy electrons, ions, and also highly excited neutral molecules or radicals are formed and act on the surface of the fiber, the water vapor desorbed from the fiber ensuring that particularly reactive particles are formed in the immediate vicinity of the respective fiber surface and these particularly reactive particles act on the surface.

The self-dispersing isocyanates useful in step (b) form part of the subject-matter of the German Patent Application bearing the reference number 197 36 542.6 (unpublished at the priority date of the present invention). Such isocyanates have an isocyanate content of 1 to 25% by weight, calculated as NCO (having a molecular weight of 42 g/mol), and are obtainable by reaction in any order of (I) organic polyisocyanates having an average NCO functionality of 1.8 to 4.2 with (II) polyalkylene oxide alcohols, amines, and/or thiols of the formula (1)

$$R^1R^2N—(CHX—CHY—O)_n—CHX—CHY—ZH \quad (1)$$

wherein n is 3to 70,

X and Y are hydrogen or methyl, with the proviso that when one of X or Y is methyl, the other must be hydrogen, $R^1$ and $R^2$ are independently straight-chain or branched $C_1$–$C_6$-alkyl radicals or straight-chain or branched $C_1$–$C_6$-acyl radicals, with the proviso that if $R^1$ is a straight-chain or branched $C_1$–$C_6$-acyl radical, then $R^2$ can also be hydrogen, or $R^1$ and $R^2$ may combine to form a —$(CH_2)$m— alkylene radical wherein m is 4, 5, 6 or 7 and one or two $CH_2$ groups can optionally be replaced by O and/or NH and/or one or two $CH_2$ groups can optionally be substituted by methyl, and z is O, S or NH, (III) optionally, other NCO-reactive compounds containing anionic, cationic, and/or potentially anionic or cationic groups, and (IV) optionally, auxiliary and additive substances.

For the purposes of the present invention, "self-dispersing" means that the isocyanates produce fine dispersions having particle sizes of less than 500 nm (measured by ultracentrifuge) in water when in a concentration of up to 70% by weight (preferably up to 50% by weight).

Examples of useful starting materials for the self-dispersing isocyanates include the following:

(I) Unmodified (i.e., not previously reacted with OH-functional compounds) aliphatic, cycloaliphatic, araliphatic, or aromatic polyisocyanates having an average NCO functionality of 1.8 to 4.2 are suitable. Preference is given to using aliphatic, cycloaliphatic, araliphatic, or aromatic polyisocyanates that have uretdione and/or isocyanurate and/or allophanate and/or biuret and/or oxadiazine structures and that can be prepared from aliphatic, cycloaliphatic, araliphatic, or aromatic diisocyanates in a conventional manner. Examples of suitable aliphatic and cycloaliphatic diisocyanates are 1,4-diisocyanatobutane, 1,6-diisocyanatohexane, 1,5-diisocyanato-2,2-dimethylpentane, 2,2,4- and 2,4,4-trimethyl-1,6-diisocyanatohexane, 1,3- and 1,4-diisocyanatocyclohexane, 1-isocyanato-3,3,5-trimethyl-5-iso-cyanatomethylcyclohexane, 1-isocyanato-1-methyl4-isocyanatomethyl-cyclohexane and 4,4-diisocyanatodicyclohexylmethane or any mixtures of such diisocyanates.

Examples of suitable aromatic diisocyanates are toluene diisocya-nate, 1,5-diisocyanatonaphthalene, and diphenylmethane diisocyanate.

The preferred polyisocyanates contain uretdione and/or isocyan-urate and/or allophanate and/or buiret and/or oxadiazine groups and have an NCO content of 19 to 24% by weight that consist essentially of trimeric reaction products of 1,6-diisocyanatohexane or 1-isocyanato-3,3,5-trimethyl-5-isocyanatomethylcyclohexane and of the corresponding higher homologs.

Particular preference is given to using the corresponding polyiso-cyanates of the mentioned average NCO content that are substantially free of uretdione groups and have isocyanate groups and that are obtainable by conventional, catalytic trimerization of 1,6-diisocyanato-hexane or 1-isocyanato-3,3,5-trimethyl-5-isocyanatomethylcyclohexane with isocyanurate formation and which preferably have an average NCO functionality of 3.2 to 4.2. Preference is also given to the trimeric polyisocyanates having an average NCO content of 19 to 24% by weight which are obtained in a conventional manner by reaction of 1,6-diisocyanato-hexane with a deficiency of water or in the presence of water-eliminating reactants and which have essentially biuret groups.

(II) Of the polyalkylene oxide alcohols, amines, and/or thiols of the formula (1), the polyalkylene oxide alcohols are preferred (i.e., Z is O in formula (1)). The polyalkylene oxide alcohols can be reacted with $NH_3$ to form polyalkylene oxide amines (i.e., Z is NH in formula (1)) and with $H_2S$ to form polyalkylene oxide thiols (i.e., Z is S in formula (1)).

The polyalkylene oxide alcohols thus underlying the polyalkylene oxide amines and thiols also contain on average 3 to 70 (preferably 6 to 60, especially 7 to 20) alkylene oxide units per molecule and are obtainable in a conventional manner by alkoxylation of suitable starter molecules. The starter molecules used can be compounds of the formula $R^1R^2NH$, which, depending on the meanings of $R^1$ and $R^2$, are secondary amines or amides. According to the definition of $R^1$ and $R^2$ mentioned for the formula (1), the alkoxylation reaction can also be started using morpholine as heterocyclic nitrogen compound. Identical compounds are further obtained by using compounds of the formula $R^1R^2N$—CHX—CH—OH, (for example 2-morpholinoethanol) as starter molecules for the alkoxylation reaction. Further useful starters include for example acylation products of ethanolamine, for example acetylethanolamine.

Alkylene oxides suitable for the alkoxylation reaction are preferably ethylene oxide and propylene oxide, which can be used in the alkoxylation reaction individually or in any desired order or else mixed. The poly-alkylene oxide alcohols are in this case based either on pure polyethylene oxides or on mixed polyethylene oxidesipropylene oxides. Particularly suitable polyalkylene oxide alcohols contain on average 3 to 70 (preferably 6 to 60 and particularly 7 to 20) alkylene oxide units per molecule and not less than 60 mol % (preferably not less than 70 mol %) of the alkylene oxide units are ethylene oxide units.

(III) The NCO-reactive compounds that contain anionic, cationic, and/or potentially anionic or cationic groups are customarily (i) hydroxyl- or amino-functional compounds having tertiary amino groups as described in U.S. Pat. No. 5,503,714 (counterpart of German Patent Application DE-A 4,319,571), which is hereby expressly incorporated herein, (ii) hydroxyl- or amino-functional compounds having carboxyl or sulfonic acid groups as described in the German Patent Application DE-A 195 20 092, which is hereby expressly incorporated herein, (iii) hydroxyl- or amino-functional compounds having carboxylate or sulfonate groups whose counterions are metal cations of the alkali metal or alkaline earth metal group or ammonium ions, as likewise described in DE-A 195 20 092, (iv) hydroxyl- or amino-functional compounds having ammonium groups that are obtainable in a conventional manner from the tertiary amino groups of the compounds (i) by alkylation or protonation as described in EP-A 582,166.

The process of the invention, as will be appreciated, may also be carried out using any desired mixtures of such NCO-reactive compounds, if chemically sensible, for example, of the groups (i) and (iv) or of the groups (ii) and (iv).

(IV) The optional auxiliary and additive substances are, for example, wetting agents, surfactants, foam inhibitors, or absorption assistants. These auxiliary and additive substances can either be inert or else reactive towards the isocyanate groups.

The unmodified polyisocyanates (I) to be used according to the invention can also be used in combination with external (i.e., additional) ionic or nonionic emulsifiers. Such emulsifiers are described for example in *Methoden der organischen Chemie,* Houben-Weyl, vol. XIV/1, part 1, page 190–208, Thieme-Verlag, Stuttgart (1961), in U.S. Pat. No. 3,428,592, and in EP-A 013,112. The emulsifiers are used in an amount sufficient to ensure dispersibility.

If initially polyisocyanates (I) are reacted with polyalkylene oxide alcohols (II), this reaction can be carried out in a conventional manner by maintaining an NCO/OH equivalents ratio of at least 2:1 (generally of 4:1 to about 1000:1). Polyethylene oxide alcohols are used. To obtain polyethylene oxide-modified polyisocyanates having an average NCO functionality of from 1.8 to 4.2 (preferably of 2.0 to 4.0) containing 12.0 to 21.5% by weight of aliphatically or cycloaliphatically attached isocyanate groups and containing 2 to 20% by weight of ethylene oxide units (calculated as $C_2H_4O$, molecular weight 44 g/mol) within the polyethylene oxide chains, the polyethylene oxide chains have on average 3 to 70 ethylene oxide units.

The starting components (I), (II), and optionally (III) can be reacted in any desired order in the absence of moisture, preferably without solvent. An increasing amount of component (II) will lead to a higher end-product viscosity. If the viscosity rises above 100 mPa.s, it is advantageous to carry out the process in the presence of a solvent that is preferably miscible with water but inert toward the polyisocyanate. Suitable solvents are, for example, alkyl ether acetates, glycol diesters, toluene, carboxylic esters, acetone, methyl ethyl ketone, tetrahydrofuran, and dimethyl-formamide.

Conventional catalysts such as dibutyltin dilaurate, tin(II) octoate, or 1,4-diazabicyclo[2,2,2]octane in amounts of 10 to 1000 ppm, based on the components (I), (II) and optionally (III), can be used to speed up the reaction of the components. The reaction is carried out in the temperature range up to 130° C. (preferably in the range between 10° C. and 100° C., particularly preferably between 200° C. and 80° C.). The reaction is monitored by determining the NCO content by titration or by measurement of the IR spectra and evaluation of the NCO band at 2260 to 2275 $cm^{-1}$ and is terminated when the isocyanate content is not more than 0.1% by weight above the value that is obtained at complete conversion under the given stoichiometry. In general, reaction times of less than 24 hours are sufficient. Preference is given to the solvent-free synthesis of the self-dispersing isocyanates to be used according to the invention.

In a further embodiment, it is also possible to prepare the self-dispersing isocyanates to be used according to the invention in step (b) by mixing (1) unmodified polyisocyanates (I), (2) polyisocyanates obtained by reaction of polyisocyanates (I) with the NCO-reactive compounds (III) at an equivalents ratio of the NCO-reactive groups of compounds (III) to the NCO groups of component (II) of 1:1 to 1:1000, and (3) polyisocyanates obtained by reaction of polyisocyanates (I) with polyalkylene oxide alcohols, amines, and/or thiols (II), at an equivalents ratio of the NCO-reactive groups of component (II) to the NCO groups of component (I) of 1:1 to 1:1000.

In this preparation variant, those skilled in the art must make use of appropriate initial weights to control the number of the NCO-reactive equivalents, the polyalkylene oxide content, the NCO content, and the NCO functionality in such a way that the mixture obtained has the composition required for water dispersibility, subject in particular to the preferred ranges already mentioned.

The self-dispersible isocyanates are industrially readily handleable and stable for many months in storage in the absence of moisture.

The self-dispersible isocyanates are preferably used without organic solvents in step (b) of the process according to the invention. Due to their self-dispersibility, they are very easy to emulsify in water at temperatures up to 100° C. without being subjected to high shearing forces. The isocyanate concentration of the emulsion can be up to 70% by weight. However, it is more advantageous to prepare emulsions having an isocyanate concentration of up to 50% by weight. Emulsification may be accomplished using the mixing assemblies customary in the art (for example, stirrers, mixers of the rotor-stator type, and high pressure emulsifying machines). In general, a static mixer is sufficient. The emulsions obtained have a processing time of up to 24 hours, which depends on the structure of the self-dispersible isocyanates used, in particular on their content of basic nitrogen atoms.

The treatment of the wool with the aqueous dispersion of the self-dispersing isocyanates in step (b) is effected according to customary processes of the art. Suitable, for example, is a batchwise method by the exhaust process or a continuous method by dipping, roll application, padding, application of a mist or spray, or backwasher application optionally using dyeing machines, stirrers, and the like to agitate the treatment liquor. The liquor ratio can be selected within wide limits and can be within the range of (20–5):1, preferably (10–5):1. The self-dispersing isocyanate is used at 0.1 to 5% by weight (preferably 0.5 to 2.5% by weight), based on the total weight of the liquor.

Performing the corona treatment at atmospheric pressure has the advantage over the low pressure plasma treatment described in DE 196 16 776 C1 in that the equipment needed is very much less complicated than in the case of the low pressure treatment. Vacuum pumps are not required nor is it necessary to fit special vacuum locks.

The following examples further illustrate details for the preparation and use of the compositions of this invention. The invention, which is set forth in the foregoing disclosure, is not to be limited either in spirit or scope by these examples. Those skilled in the art will readily understand that known variations of the conditions and processes of the following preparative procedures can be used to prepare these compositions. Unless otherwise noted, all temperatures are degrees Celsius and all parts and percentages are parts by weight and percentages by weight, respectively.

EXAMPLES

I Preparation of the self-dispersing isocyanate 85 parts by weight of an isocyanate having an NCO content of 22.5% and consisting essentially of trimeric hexamethylene diisocyanate are reacted at 60° C. with 15 parts by weight of a morpholine-started ethylene oxide polyether having an average molecular weight of 420. The resultant product has an NCO content of 16.5% and a viscosity of 2550 mPas at 25° C. The product is very efficiently dispersible in a water-filled glass beaker by simply stirring with a glass rod. The arithmetic NCO functionality F is 2.76.

II Plasma pretreatment

The initial step is to subject moist wool stubbing to a corona plasma treatment by observing the following settings:

| | |
|---|---|
| Frequency | 23.0 Hz |
| Roll gap | 0.8 mm |
| Air supply | 400.0 l/min |
| Pulse continuous waves on | 2 |
| Pulse continuous waves off | 8 |
| Spreading | 1:2 |
| Forward feed | 10 m/min |
| Power | 780 W |

III Wet-chemical treatment with the self-dispersing isocyanate

For the wet-chemical treatment, 30 ribbons of stubbing (weight 10 g/m) are guided in a parallel arrangement at a speed of 5 m/sec through three successive baths:

Bath 1: prewetting bath of water (temperature 40° C.)

Bath 2: finishing bath containing a buffered aqueous dispersion of the self-dispersing isocyanate (temperature 40° C.)

Bath 3: rinse bath of water (room temperature)

The baths are backwashes that have a capacity of 450 liter and hold a sieve drum around which the slubbing is passed. At the same time, the bath contents are agitated and recirculated by powerful recirculation pumps, so that there is intensive flow through the slubbing. Upon leaving the bath, the slubbing is freed of adherent excess liquor by a set of squeeze rolls.

The then thoroughly rinsed slubbing is initially directed into a sieve drum dryer where it is dried in three zones; the independently selected temperature settings for the zones are reported in the table below.

The first dryer is followed by a water bath at room temperature and then by a second sieve drum dryer having the same settings as described above. The treated wool is coiled into cans.

To determine the felting resistance, the finished stubbing is spun into a yarn according to IWS standard TM 31 (The Woolmark Company, IWS test method TM 31, July 1996) and knitted up. The knit is subjected to 5 wash cycles before its area shrinkage is determined in %. The area shrinkage is a measure of the felting tendency. The lower the area shrinkage value, the lower the felting tendency and the better the antifelting finish.

The table below summarizes the experimental conditions and the area shrinkage values obtained.

TABLE

| Test | 1 | 2 | 3 | 4 | 5 |
|---|---|---|---|---|---|
| SeIf-dispersing isocyanate [g/l] | 5.0 | 2.5 | 2.5 | 2.5 | 5.0 |
| pH | 7* | 7** | 7** | 5*** | 7* |
| Temperature of sieve drum dryer 1 + 2 | | | | | |
| Zone 1 | 47.0 | 75.0 | 85.0 | 56.1 | 59.3 |
| Zone 2 | 53.6 | 78.2 | 100.2 | 92.9 | 108.7 |
| Zone 3 | 57.4 | 76.0 | 108.9 | 87.0 | 108.9 |
| Area shrinkage(1) | 2.0 | 1.0 | 1.4 | 5.6 | 5.0 |

(1)Area shrinkage measured according to TM 31 (mean of five measurements)

*500 L of liquor contain: 5000 g of self-dispersing isocyanate and also
275 g of sodium dihydrogen phosphate
750 g of disodium hydrogen phosphate

**500 L of liquor contain: 2500 g of self-dispersing isocyanate and also
275 g of sodium dihydrogen phosphate
750 g of disodium hydrogen phosphate

***500 L of liquor contain: 2500 g of self-dispersing isocyanate and also
1500 g of sodium acetate
450 g of glacial acetic acid

What is claimed is:

1. A nonfelting wool prepared by a process comprising (a) exposing wool to a plasma in a corona treatment, and (b) subsequently treating the treated wool with an aqueous dispersion of self-dispersing isocyanates.

2. A nonfelting wool according to claim 1 wherein the wool is raw wool after the raw wool scour, dyed or undyed wool slubbing, or dyed or undyed wool yarn, knits, or cloths.

3. A nonfelting wool according to claim 1 wherein the corona treatment is carried out at a pressure within the range from 100 mbar to 1.5 bar.

4. A nonfelting wool according to claim 1 wherein the self-dispersing isocyanates used in step (b) have an isocyanate content of 1 to 25% by weight, determined as NCO and are obtained by reaction in any order of (I) organic polyisocyanates having an average NCO functionality of 1.8 to 4.2 with (II) polyalkylene oxide alcohols, amines and/or thiols of formula (1)

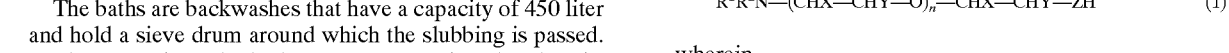

$$R^1R^2N—(CHX—CHY—O)_n—CHX—CHY—ZH \quad (1)$$

wherein n is3 to 70,

X and Y are hydrogen or methyl, with the proviso that when one of X or Y is methyl, the other must be hydrogen, $R_1$ and $R^2$ are independently straight-chain or branched $C_1$–$C_6$-alkyl radicals or straight-chain or branched $C_1$–$C_6$-acyl radicals, with the proviso that if $R^1$ is a straight-chain or branched $C_1$–$C_6$-acyl radical, then $R^2$ can also be hydrogen, or $R^1$ and $R^2$ may combine to form a —$(CH_2)_m$-alkylene radical wherein m is 4, 5, 6 or 7 and one or two $CH_2$ groups can optionally be replaced by O and/or NH and/or one or two $CH_2$ groups can optionally be substituted by methyl, and z is O, S or NH, (III) optionally, other NCO-reactive compounds containing anionic, cationic, and/or potentially anionic or cationic groups, and (IV) optionally, auxiliary and additive substances.

5. A nonfelting wool according to claim 4 wherein the organic lyisocyanates (I) are unmodified aliphatic, cycloaliphatic, araliphatic, or a romatic isocyanates having an average NCO functionality of 1.8 to 4.2.

6. A nonfelting wool according to claim 4 wherein the poly-lkylene oxide alcohols, amines, and/or thiols of formula (1) contain on a verage 6 to 60 alkylene oxide units per molecule.

7. A nonfelting wool according to claim 6 wherein the poly-alkylene oxide alcohols, amines, and/or thiols of formula (1) are polyethylene oxide/propylene oxide alcohols, amines, and/or thiols.

8. A nonfelting wool according to claim 6 wherein the poly-alkylene oxide alcohols, amines, and/or thiols of formula (1) are polyethylene oxide/propylene oxide alcohols, amines, and/or thiols containing not less than 60 mol % of ethylene oxide units, based on the sum total of ethylene oxide and propylene oxide units.

9. A nonfelting wool according to claim 4 wherein the NCO-reactive compounds (III) are (i) hydroxyl- or amino-functional compounds having tertiary amino groups, (ii) hydroxyl- or amino-functional compounds having carboxyl or sulfonic acid, (iii) hydroxyl- or amino-functional compounds having carboxylate or sulfonate groups whose counterions are metal cations of the alkali metal or alkaline earth metal group or ammonium ions, and/or (iv) hydroxyl- or amino-functional compounds having ammonium groups that are obtained from the tertiary amino groups of the compounds (i) by alkylation or protonation.

10. A process for the antifelt finishing of wool comprising (a) exposing the wool to a plasma in a corona treatment, and (b) subsequently treating the treated wool with an aqueous dispersion of self-dispersing isocyanates.

11. A process for the antifelt finishing of wool according to claim 10 wherein step (b) is effected in an exhaust process or continuously by dipping, roll application, padding, or application of a mist or spray.

12. A process for the antifelt finishing of wool according to claim 10 wherein the corona treatment of the wool is carried out for a period of 1 to 60 seconds by applying an alternating voltage of 1 to 20 kV in the frequency range between 1 kHz to 1 GHz, the alternating voltage being supplied either continuously, with individual pulses, or with pulse trains and pauses in between.

* * * * *